United States Patent [19]

McConnell, Jr.

[11] Patent Number: 4,702,425

[45] Date of Patent: Oct. 27, 1987

[54] VIBRATORY CRUSHING APPARATUS

[76] Inventor: David P. McConnell, Jr., 9333 East Apache Trail, Suite 21, Box 149 Mesa, Ariz. 85207

[21] Appl. No.: 823,310

[22] Filed: Jan. 28, 1986

[51] Int. Cl.[4] ..... B02C 2/04

[52] U.S. Cl. ..... 241/156; 241/208

[58] Field of Search ..... 241/156, 175, 179, 207–216

[56] References Cited

U.S. PATENT DOCUMENTS 4,588,137 5/1986 McConnell, Jr. ..... 241/156

FOREIGN PATENT DOCUMENTS 435959 10/1935 United Kingdom ..... 241/156

*Primary Examiner*—Timothy V. Eley

*Attorney, Agent, or Firm*—John A. Bucher

[57] ABSTRACT

Vibratory crushing apparatus is disclosed including a mandrel support housing suspended on a frame structure and providing floating support for a vertically arranged mandrel. Upper and lower collar housings are arranged upon the mandrel support housing and define upper and lower faces for crushing interaction with the mandrel. A shaft extends along the mandrel axis on bearings with opposed eccentric masses attached to its ends by hinges. The circumferential face on the upper collar is tapered for receiving relatively large materials to be crushed. Components of the crusher are of modular construction to facilitate repair and maintenance and a cylindrical ring secured to a central portion of the mandrel functions in combination with the upper and lower collar members to form a passage for conducting material to be crushed through the apparatus. With the mandrel and circumferential faces of the upper and lower collars being cylindrical, a resilient coupling is provided between a portion of the mandrel and a generally non-rotating portion of the apparatus to resist rotation of the mandrel.

20 Claims, 4 Drawing Figures

VIBRATORY CRUSHING APPARATUS

FIELD OF THE INVENTION

The present invention relates to a vibratory crusher and more particularly to such a crusher which is adapted for producing oscillatory vibrating movement of opposed surfaces in upper and lower portions of the crusher for effectively and efficiently crushing rocks and other crushable materials.

BACKGROUND OF THE INVENTION

Conventional oscillating or rotating vibratory crushers available in the past have generally been formed with a rotor positively driven in eccentric fashion relative to a surrounding stator. The stator commonly has a cylindrical or more commonly a cone shaped configuration, a crushing effect being produced between the rotor and stator. Within such a crusher, the positive eccentric drive of the rotor relative to the stator introduces a number of problems. For example, very heavy mountings are necessary for the rotor and stator in order to resist the positive eccentric drive forces applied to the rotor. The positively coupled drive for the rotor tends to cause damage or plugging within the crusher when material such as metal enters betwen the motor and stator. If such metallic articles and the like are sufficiently ductile to resist crushing, their presence within the crusher may cause damage to a portion of the crusher or plug the crusher and prevent its continued operation. Uncrushable metallic objects or the like presented a more substantial problem in such prior art crushers because they in effect presented an immovable object resisting operation of the positively driven rotor. Accordingly, damage and/or plugging were even more likely in the crusher.

At the same time, such conventional crushers were found to be generally inefficient because of the need to provide the positive eccentric drive for the rotor relative to the fixed stator.

Reference is also made to another type of vibratory crusher described particularly within U.S. Pat. No. 3,079,096 entitled CRUSHING APPARATUS and issued Feb. 26, 1963 to David P. McConnell, father of tbe present inventor.

That patent disclosed a vibratory jaw type crusher wherein a pair of opposed crusher jaws were mounting on a frame for floating vibratory movement toward and away from each other, eccentric drive forces being applied to the jaws for developing synchronized vibratory movement of the jaws in order to produce powerful crushing action between the jaws with relatively low power requirements.

More particularly, the jaws were driven by respective shafts with eccentric weights arranged upon the shafts so that the jaws operated in unison and experienced gyratory or oscillatory vibrating movement upwardly and away from one another and then downwardly and toward one another. This action caused material being crushed between the jaws to move in a downward direction, thereby resulting in the desired crushing action at a suitably effective rate.

Thereafter, the present inventor developed a vibrating crusher of the same general type as the crusher of the present invention. That crusher is described within a copending reference, U.S. patent application Ser. No. 584,325 filed Feb. 28, 1984 and entitled VIBRATORY CRUSHER, now U.S. Pat. No. 4,588,137 issued May 13, 1986. Since the crusher of the above noted reference includes certain features in common with the present invention, that reference is incorporated herein as though set forth in its entirety in order to better assure a complete understanding of the present invention.

Even with the improved crushing effect provided by the incorporated reference, further improvements in such crushers have been found desirable, for example to improve crushing capacity, to reduce power requirements, to facilitate passage of crushed material through the apparatus, for achieving more uniform crushing and for facilitating maintenance and repairs, etc.

SUMMARY OF THE INVENTION

It is therefore an object of the invention to provide an oscillatory vibrating crusher of the type referred to above with one or more improvements of the type summarized immediately above.

It is a further object of the invention to provide an oscillatory vibrating crusher comprising a mandrel driven by opposed eccentric masses on a rotating shaft for producing oscillatory and vibrating crushing action relative to circumferential faces adjacent the upper and lower portions of the mandrel respectively, hinge means coupling the eccentric masses to the shaft so that the eccentric masses are permitted to freely respond to centrifugal forces without resisting constantly changing inclination of the shaft during operation of the crusher.

The eccentric masses were necessarily formed with very substantial weights in order to produce the opposed oscillatory patterns of movement for the upper and lower ends of the mandrel as described in the incorporated reference above and described in greater detail below. However, in addition to producing the desired patterns of oscillatory vibrating movement for the mandrel, the substantial weights of the eccentric masses caused them to attempt to respond to centrifugal force by remaining in a generally constant plane. To this extent, the eccentric masses exhibited a gyroscopic effect which had to be continuously overcome because of the continually varying inclination of the shaft during operation of the crusher. It was found that by hinging the counter weights on the mandrel shaft, it was possible to permit the eccentric masses to freely respond to centrifugal force regardless of the inclination of the shaft and therefore the eliminate very substantial stresses which were found to develop in the shaft for overcoming the gyroscope effect referred to above with the eccentric masses being rigidly secured to the shaft. Accordingly, the hinged connection of the counter weights to the shaft were found to not only eliminate or minimize stress in the shaft but also to reduce power requirements for the crusher.

It is yet anotber object of the invention to provide a vibratory crusher of the type generally referred to above wherein in the mandrel and upper and lower circumferential face portions providing crushing operation with the mandrel are generally cylindrical, resilient anti-rotation means being coupled between a portion of the mandrel and an adjacent substantially non-rotating element of the crusher. This provided a simple and effective means for eliminating a tendency of the mandrel to rotate in response to interaction with the circumferential face portions through the medium of the material being crushed. Such rotation of the mandrel was found to be undesirable in that it interfered with providing a floating mount for the mandrel within the crusher.

Use of the resilient anti-rotation means of the present invention was found to effectively resist such rotation while not interfering with the desired oscillatory and vibratory movement of the mandrel.

It is a still further object of the invention to provide such a vibratory crusher for producing crushing at both the upper and lower ends of a mandrel wherein a lower reaction collar member and a corresponding lower portion of the mandrel are proportionally larger than an upper reaction collar member and corresponding upper portion of the mandrel in order to balance the flow rate of crushed material through the crusher.

Still another object of the invention is to provide such a crusher which is constructed for facilitating crushing operation while also facilitating necessary repairs and maintenance. For achieving this object, the crusher preferably comprises a frame structure, a support housing vertically supporting the mandrel and mounted upon the frame structure, the mandrel including a rotatable shaft with offset eccentric masses for producing oscillatory vibrating movement of the mandrel in the crusher, drive means being flexibly coupled with an upper end of the mandrel, upper and lower reaction collar housings being mounted on the mandrel support housing to form reaction collar members surrounding upper and lower ends of the mandrel.

Such a combination was found to be particularly desirable in that it permitted arrangement of a motor means for driving the crusher in a relatively clean environment at the upper end of the crusher. At the same time, the mounting of the reaction collar housings on the mandrel support housing facilitated maintenance and repairs particularly necessary for the hardened circumferential faces in the collar housings.

This arrangement for the crusher also made possible a number of additional advantages. For example, an enlarged cylindrical ring is preferably secured in spaced apart relation to a central portion of the mandrel for forming a passage therebetween to receive crushed material from the upper collar housing and for directing that crushed material between the lower collar member and an adjacent portion of the mandrel for further crushing. The upper lower collar housings are preferably configured for functioning in combination with the cylindrical ring on the mandrel.

At the same time, the above combination generally facilitated resilient mounting of the mandrel on the mandrel support housing with the mandrel support housing itself being suspended by resilient means upon the frame structure in order to further facilitate operation of the crusher and to further reduce power requirements for the crusher.

Many of the objects and preferred features of the invention as described above were found to be particularly effective in combination with each other. Accordingly, it is yet a further related object of the invention to employ various of the above features in combination for further enhancing operation and durability of the crusher.

Additional objects and advantages of the invention are described below with reference to the accompanying drawings or will be apparent to those skilled in the art from the following description in combination with the drawings.

DESCRIPTION OF THE PREFERRED EMBODIMENT

Figure 1:
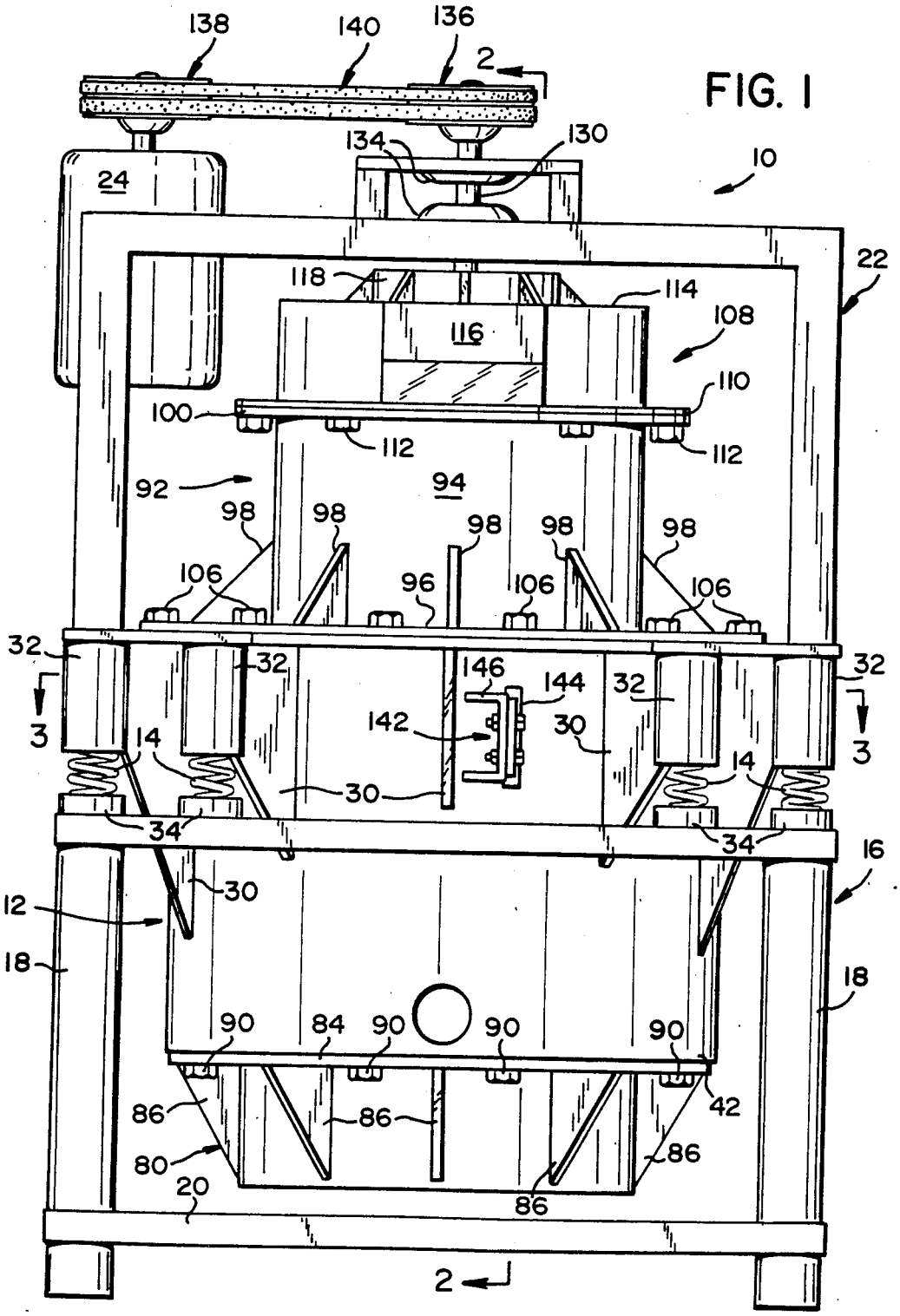
FIG. 1 is a side view in elevation of a vibratory crusher constructed in accordance with the present invention.

Referring now to the drawings, a crusher construction in accordance with the present invention is generally indicated at 10. The components of the crusher 10 are described below generally in the order of their assembly into the crusher 10 in order to better emphasize modular construction of the crusher which facilitates maintenance and repairs in the crusher which will be discussed in greater detail below.

Figure 2:
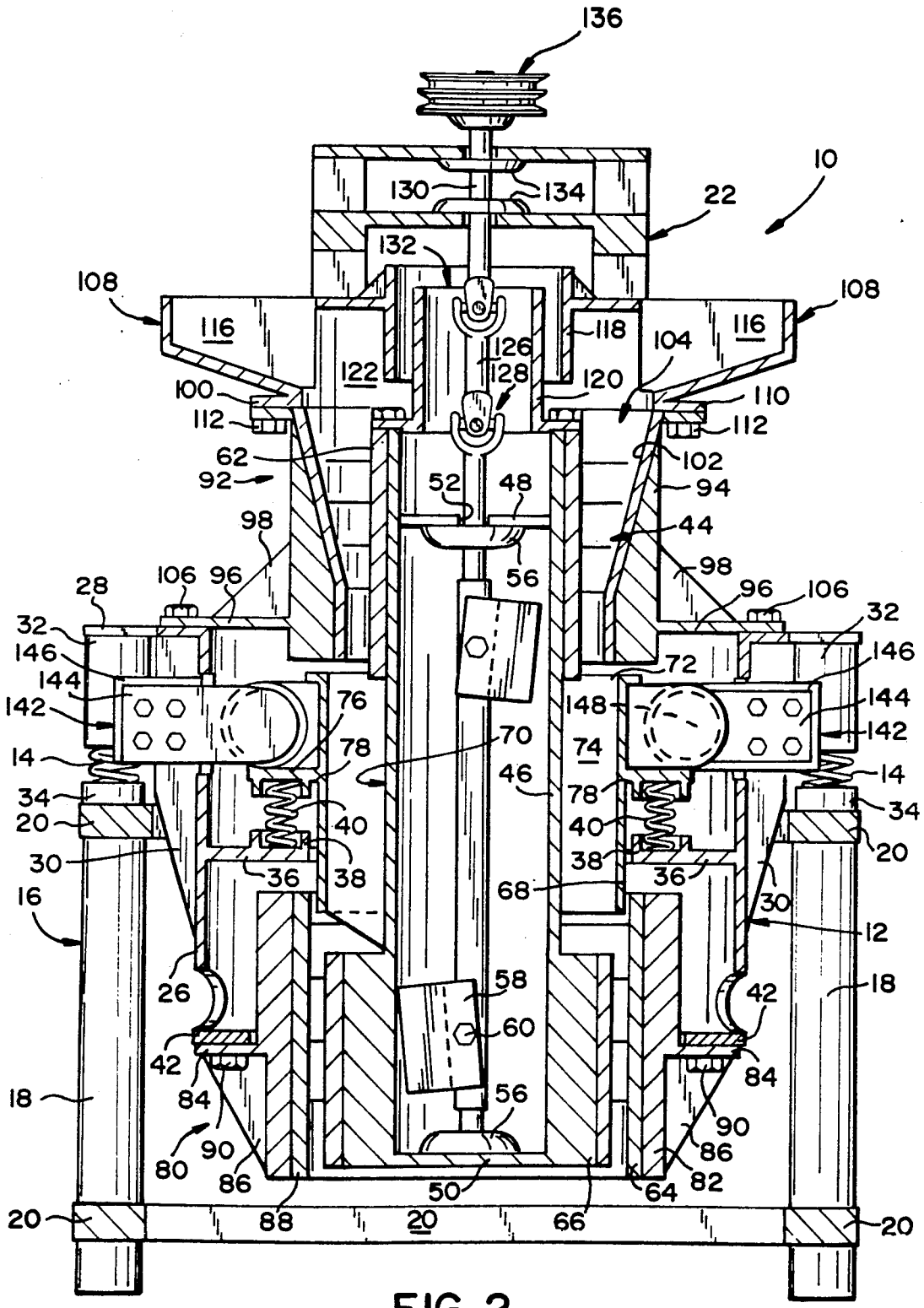
FIG. 2 is an axially sectioned view of the crusher taken along section line 2—2 of FIG. 1 with parts illustrated in section to better show internal construction of the crusher.

Initially, referring particularly to FIG. 2, a fabricated mandrel support housing 12 is suspended by resilient means or springs 14 on a fabricated framework 16.

Generally, tbe structural framework 16 comprises upright members 18 arranged at the corners of the crusher and interconnected by various cross members 20. A fabricated extension 22 extends upwardly from a generally central portion of the framework 16 for mounting a drive motor 24 which is connected with the crusher 10 in a manner described in greater detail below.

The mandrel support housing 12 is formed with a large cylindrical section 26 having a rectangular mounting flange 28 secured to the cylindrical section 26 and reinforced by means of gussets 30. Clusters of spring retaining cups 32 are arranged at each corner of the rectangular mounting flange 28. The cups 32 on the flange 28 face downwardly in opposed alignment with similar spring retaining cups 34 formed on the framework 16. The resilient means 14, in the form of heavy compression springs, are arranged in the retaining cups 34 on the framework with the mandrel support housing then being suspended by interaction of the springs 14 in its retaining cups 32. The gussets 30 also provide reinforcing support for the retaining cups 32.

An internal flange 36 is formed as an annular extension of the cylindrical section 26 and is provided with a multiplicity of circumferentially arranged, upward opening spring retaining cups 38 for respectively receiving compression springs 40 to provide floating support for the mandrel described below.

Before leaving the construction of the mandrel support housing 12 it is noted that the rectangular flange 28 at the upper end of the housing and flange or bracket means 42 at the lower end of the housing 12 provide means for modularly supporting other portions of the crusher 10 upon the housing 12.

Referring again particularly to FIG. 2, the mandrel for the crusher 10 is generally indicated at 44 and is formed with an elongated cylinder 46 having closures 48 and 50 respectively at its upper and lower ends. The upper closure 48 includes a passage 52 for receiving a mandrel shaft 54 extending the axial length of the mandrel and projecting upwardly through the opening 52. The shaft 54 is supported on the plates 48 and 50 by means of similar bearings 56.

Eccentric masses 58 are secured in opposed and offset relation to each other generally at opposite ends of the shaft 54 by respective hinge means 60 which provide a particularly important feature of the invention which will be described in greater detail below.

Hardened cylindrical crushing faces 62 and 64 are formed respectively on the upper and lower ends of the mandrel. The hardened crushing face 64 at the lower end of the mandrel is arranged on an enlarged or stepped portion 66 of the mandrel so that the hardened cylindrical crushing face 64 has a substantially greater diameter than the upper cylindrical face 62. The reason for this proportional difference in sizing is also discussed below.

An enlarged cylindrical ring 68 is mounted in annularly spaced apart relation to a central portion 70 of the mandrel for forming an annular passage 72 which serves to direct crushed material from the upper end of the crusher 10 toward its lower end in a manner also discussed in greater detail below. The cylindrical ring 68 is secured to the mandrel 44 by means of circumferentially spaced apart gussett plates 74.

An annular flange 76 extends radially outwardly from the ring 68 of the mandrel and forms circumferentially spaced apart spring retaining cups 78. The flange 76 overlaps the flange 36 on the mandrel support housing so that the spring retaining cups 78 and 38 are in respective and opposed aligned with each other to receive the compression springs 40. Thus, the circumferentially spaced apart arrangement of springs 40 serves to provide floating support for the mandrel 44 relative to the mandrel support housing 12.

The purpose and function for various features of the mandrel described above will be discussed in greater detail below after other components of the crusher 10 have been described.

A lower collar housing 80 is formed with a cylindrical member 82 having an annular flange 84 connected in reinforced fashion by circumferentially spaced apart gussett plates 86.

Internally, the lower collar housing 80 has a cylindrically hardened face 88 with an inside diameter greater than the diameter of the cylindrical hardened crushing face 64 on the mandrel to permit crushing action therebetween.

In construction or assembly of the crusher 10 the flange 84 of the lower collar housing 80 is attached to the flange or bracket 42 at the bottom of the mandrel support housing 12 by means of bolts 90. In practice, the lower collar housing 80 is attached to the mandrel support housing 12 before the housing 12 is suspended on the framework 16. This modular assembly of the lower collar housing 80 on the mandrel support housing 12 is particularly important for providing access to the hardened surface 88 for purposes of maintenance or repair.

An upper collar housing 92 includes a cylindrical member 94 having an annular flange 96 reinforced by gussett plates 98 at its lower end and another flange 100 at the upper end of the cylindrical member 94.

A hardened cylindrical crushing face 102 is formed on the cylindrical member 94. The lower end of the hardened cylindrical face 102 has an inside diameter substantially larger than the diameter of the hardened crushing face 62 on the mandrel in order to carry out a first crushing operation therebetween at the upper end of the crusher. The hardened cylindrical face 102 tapers upwardly and outwardly to form an enlarged opening 104 adjacent the upper end of the mandrel for receiving relatively large rocks or other material to be crushed.

The upper collar housing 92 is modularly mounted within the crusher 10 with its flange 96 being attached to the rectangular flange 28 of the mandrel support housing 12 by means of bolts 106.

A closure housing 108 has an annular flange 110 which is secured to the upper flange 100 of the upper collar housing 92 by bolts 112. The housing 108 is formed with a plate 114 at its upper end and feed hoppers 116 which are circumferentially spaced about the housing 108 for introducing rock or other material to be crushed into the crusher 10.

A cylindrical portion 118 overlaps a smaller upward extension 120 on the mandrel in order to provide, in effect, a labyrinth seal for preventing rock, dust or debris entering the feed hoppers 116 from having access to the top of the mandrel, particularly the bearing 56.

The closure housing 108 forms an enlarged annular region 122 for communicating the feed hoppers 116 with the enlarged passage 104 formed between the upper end of the mandrel and the hardened cylindrical face 102.

A flexible drive means 124 is formed at the upper end of the crusher by means of a shaft 126 coupled at one end with the drive shaft 54 for the mandrel by means of a first universal coupling 128 and at its other end with a fixed drive shaft 130 by means of a second universal coupling 132. Referring also to FIG. 1, the rigid shaft 130 is supported for rotation in the framework extension 22 by bearings 134. Referring also to FIG. 1, the shaft 130 is connected with pulley means 136 which are coupled in driven relation with similar pulley means 138 on the motor 24 by means of belts 140.

Before briefly describing the method of operation for the crusher 10, the mandrel support housing 12 also includes anti-rotation means 142 arranged in balanced or circumferentially spaced apart relation for resisting rotation of the mandrel. Because of the cylindrical configuration of the mandrel, it tends to be rotated by interaction with the hardened surfaces 102 and 88 through the medium of the rocks or other material being crushed.

Figure 3:
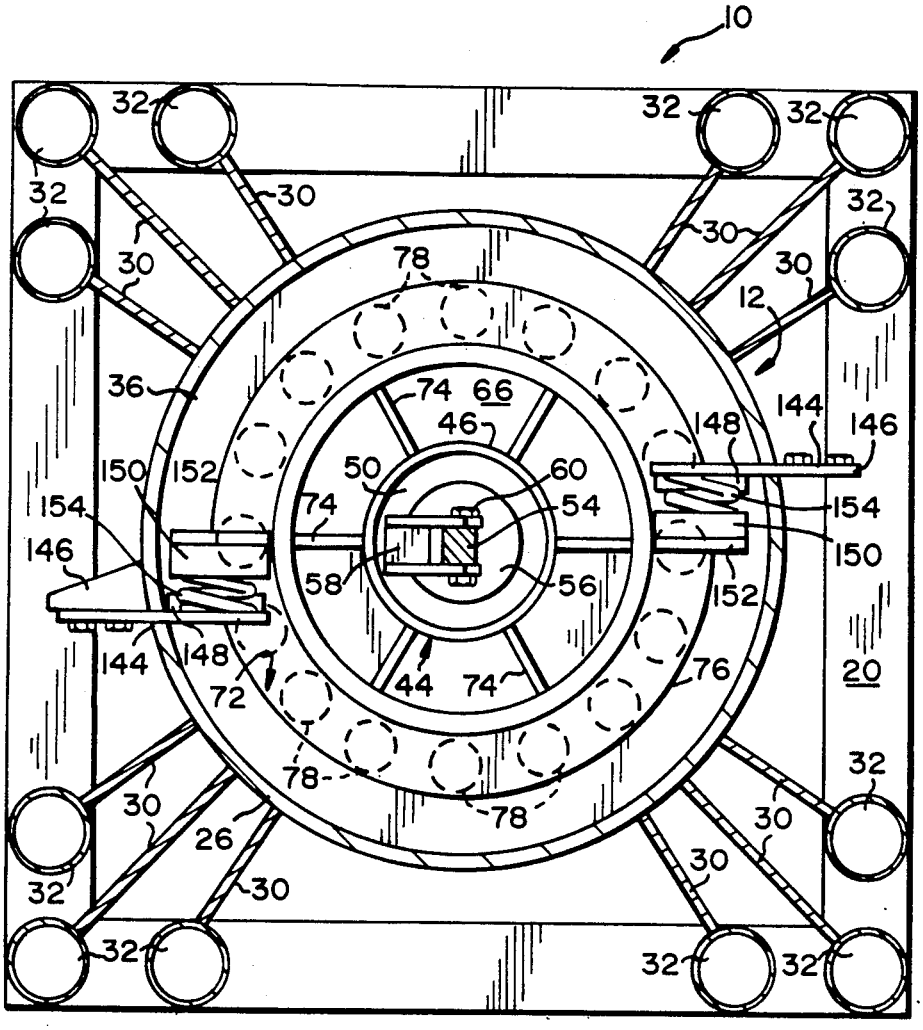
FIG. 3 is similarly a view taken along section line 3—3 of FIG. 1 across a central portion of the crusher, again with parts in section, for also better showing internal construction of the crusher.
Figure 4:
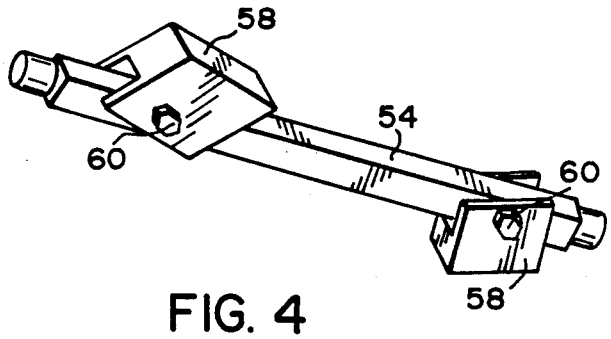
FIG. 4 is a perspective view of a shaft adapted for mounting in a mandrel of the crusher by means of bearings carrying eccentric masses for producing oscillatory vibrating movement in the mandrel.

To resist this rotation, the anti-rotation means 142 include plates 144 mounted on brackets 146 on opposite sides of the housing 12. Spring retaining cups 148 are arranged on inwardly extending ends of the plates 144 in opposition to and alignment with similar spring retaining cups 150 mounted on plates 152 extending radially from the mandrel. As is better illustrated in FIG. 3, springs 154 are arranged between the respective spring retaining cups 148 and 150 to provide balanced resistance to rotation of the mandrel. It is particularly important that the mandrel 44 be secured against rotation in order to maintain proper alignment of the springs 48 between the spring retaining cups 48 and 78 (see FIG. 2).

It is believed that operation of the crusher 10 will be apparent from the preceding description. However, the method of operation for the crusher 10 is described briefly below in order to assure a complete understanding of the invention.

With the crusher 10 being modularly assembled in the manner described above, the motor 24 is operated to drive the shaft 54 in rotation. The eccentric masses 58 are rotated with the shaft 54. Because of their balance and opposed relation upon the shaft 54, they tend to produce opposed patterns of oscillatory and vibratory movement for the upper and lower ends of the mandrel 44. With the eccentric masses 58 being rotated very rapidly, crushing actions is thus produced between the respective ends of the mandrels and the hardened collar faces 102 and 88 as also discussed above.

Rock and other material to be crushed is introduced through the feed hoppers 116 and distributed by means of the annular passage 122 into the enlarged opening 104 at the upper end of the crusher. Because of the crushing effect between the hardened surface 102 and the upper end of the mandrel, the rock is crushed or broken down as it passes downwardly therebetween until it is reduced to a size approximately equal to or smaller than nominal spacing between the lower end of the hardened face 102 and the hardened cylindrical face 62 on the mandrel.

The rock or other crushed material exiting downwardly from the lower end of the hardened surface 102 is directed through the annular passage 72 toward the lower end of the mandrel where the rock or other material is further crushed between the hardened cylindrical faces 88 and 64 formed by the lower collar housing 80 and lower end of the mandrel respectively.

Since a substantially larger "breakdown" ratio is achieved during crushing at the lower end of the mandrel relative to the upper end, it has been found that substantially more crushing effort or work is required between the surfaces 64 and 88 compared to that required between the upper surfaces 62 and 102. Accordingly, the hardened surfaces 64 and 88 are formed with enlarged diameters relative to the hardened surfaces 62 and 102 at the upper end of the crusher. Because of the larger diameter at the lower end of the crusher, greater crushing area is provided to achieve the increased crushing effect necessary for maintaining balanced feed flow of crushed material through the upper and lower ends respectively of the crusher.

During operation, the mandrel is supported in floating relation upon the mandrel support housing 12 by means of the springs 40. At the same time, the mandrel support housing 12 is resiliently supported on the framework 16 by the springs 15 in order to isolate oscillatory and vibratory forces on the mandrel and somewhat in the mandrel support housing 12 from the framework 16. At the same time, the anti-rotation means 142 resists rotation of the mandrel 44 so that the supporting springs 40 remain in proper alignment between the respective retaining cups 38 and 78.

Numerous variations and motifications for the construction and method of operation for a crusher constructed in accordance to the present invention are believed obvious in addition to those specifically described above. Accordingly, the scope of the present invention is defined only by the following appended claims.

What is claimed is:

1. A crusher comprising a supporting frame structure, upper and lower reaction collar members mounted upon the frame structure, an elongated mandrel having a shaft extending along an axis of the mandrel and supported for rotation relative to the mandrel by bearing means, eccentric masses being mounted in opposed offset relation to each other on opposite ends of the shaft, support means providing floating support for the mandrel with end portions of the mandrel being respectively arranged within the first and second reaction collar members, means for driving the shaft in rotation whereby the eccentric masses on the shaft cause the end portions of the mandrel to gyrate relative to the reaction collar members for producing an oscillatory vibrating crushing effect therebetween, and hinge means respectively coupling the eccentric masses to the shaft whereby the eccentric masses can freely respond to centrifugal forces while not resisting constantly changing inclination of the shaft during operation of the crusher.

2. The crusher of claim 1 wherein the opposed eccentric masses are balanced with respect to each other so that opposite ends of the mandrel gyrate or oscillate in balanced opposition to each other.

3. The crusher of claim 1 wherein the upper and lower reaction collar members have hardened circumferential faces and the mandrel has hardened circumferential face portions adjacent the circumferential faces of the upper and lower collar members.

4. The crusher of claim 3 wherein the support means comprises circumferentially spaced apart resilient means supporting the mandrel and further comprising resilient anti-rotation means coupled between a portion of the mandrel and an adjacent substantially non-rotating element of the crusher.

5. The crusher of claim 4 further comprising balanced resilient anti-rotation means respectively coupled with circumferentially balanced portions of the mandrel.

6. The crusher of claim 3 wherein the upper circumferential collar member face tapers upwardly and outwardly for accepting relatively larger material to be crushed, the lower circumferential collar member face being of generally uniform dimension along its axial length for achieving more uniform fine crushing.

7. The crusher of claim 6 wherein the lower circumferential collar member face and corresponding lower mandrel portion are proportionally larger than the upper circumferential collar member face and corresponding upper mandrel portion in order to balance the flow rate of crushed material through the crusher.

8. The crusher of claim 1 wherein the lower reaction collar member and corresponding lower portion of the mandrel are proportionally larger than the upper reaction collar member and corresponding upper portion of the mandrel in order to balance the flow rate of crushed material through the crusher.

9. A crusher comprising a supporting frame structure, upper and lower collar members mounted upon the frame structure, the upper and lower collar members each having hardened circumferential face portions, an elongated cylindrical mandrel having a shaft extending along an axis of the mandrel and supported for rotation relative to the mandrel by bearing means, eccentric masses being mounted in opposed offset relation to each other on opposite ends of the shaft, support means providing floating support for the mandrel and comprising circumferentially spaced apart resilient means supporting the mandrel, means for driving the shaft in rotation whereby the eccentric masses on the shaft cause the ends of the mandrel to gyrate relative to the collar members for producing an oscillatory vibrating crushing effect therebetween, and resilient anti-rotation means coupled between a portion of the mandrel and an adjacent substantially non-rotating element of the crusher.

10. The crusher of claim 9 further comprising balanced resilient anti-rotation means respectively coupled with circumferentially balanced portions of the mandrel.

11. The crusher of claim 9 wherein the lower circumferential collar member face and corresponding lower mandrel portion are proportionally larger than the upper circumferential collar member face and corresponding upper mandrel portion in order to balance the flow rate of crushed material through the crusher.

12. A crusher comprising a frame structure, a mandrel support housing mounted on the frame structure, an elongated mandrel having a shaft extending along an axis of the mandrel and supported for rotation on the mandrel by bearing means, eccentric masses being mounted in opposed offset relation to each other on opposite ends of the shaft, hinge means respectively coupling the eccentric masses to the shaft whereby the eccentric masses can freely respond to centrifugal forces while not resisting constantly changing inclination of the shaft during operation of the crusher, floating support means vertically suspending the mandrel on the mandrel support housing, an upper reaction collar housing mounted on the mandrel support housing and forming an upper reaction collar member surrounding an upper end of the mandrel, flexible drive means coupling an upper end of the mandrel with motor means for driving the shaft in rotation, feed means for introducing material to be crushed between the upper reaction collar member and the mandrel, and a lower reaction collar housing mounted on the mandrel support housing and forming a lower reaction collar member surrounding a lower end of the mandrel.

13. The crusher of claim 12 wherein the lower reaction collar member and corresponding lower portion of the mandrel are proportionally larger than the reaction collar member and corresponding upper portion of mandrel in order to balance the flow rate of crushed through the crusher.

14. The crusher of claim 13 wherein the upper circumferential collar member face tapers upwardly and outwardly for accepting relatively larger material to be crushed, the lower circumferential collar member face being of generally uniform dimension along its axial length for achieving more uniform fine crushing.

15. The crusher of claim 14 wherein the mandrel comprises an enlarged cylindrical ring secured in spaced apart relation to a central portion of the mandrel for forming therebetween an annular passage for receiving crushed material from the upper collar housing and directing it between the lower collar member and adjacent portion of the mandrel.

16. The crusher of claim 15 further comprising an annular flange extending radially outwardly from the cylindrical ring and having circumferentially spaced spring mounts, the mandrel support housing comprising a similar annular flange with similar circumferentially spaced spring mounts arranged in aligned and opposed relation to the spring mounts on the annular flange of the mandrel, the floating support means comprising spring means arranged between the respectively opposed spring mounts.

17. The crusher of claim 16 further comprising resilient anti-rotation means coupled between a portion of the mandrel and an adjacent substantially non-rotating element of the crusher.

18. The crusher of claim 12 wherein the upper and lower reaction collar housings are of modular construction and are removably secured to the support housing to facilitate repairs to the respective reaction collar members.

19. The crusher of claim 12 wherein the mandrel is cylindrical at least at its upper and lower end portions adjacent the upper and lower reaction members and the upper and lower reaction collar members have hardened circumferential faces arranged for crushing interaction with the mandrel.

20. The crusher of claim 19 wherein the support means comprises circumferentially spaced apart resilient means supporting the mandrel and further comprising resilient anti-rotation means coupled between a portion of the mandrel and an adjacent substantially non-rotating element of the crusher.

* * * * *